US010537765B2

(12) United States Patent
Borés Cifo

(10) Patent No.: US 10,537,765 B2
(45) Date of Patent: Jan. 21, 2020

(54) FITNESS SET

(71) Applicant: POWERINSTEP, S.L., El Masnou (ES)

(72) Inventor: Vicente Borés Cifo, Barcelona (ES)

(73) Assignee: POWERINSTEP, S.L., El Masnou (ES)

( * ) Notice: Subject to any disclaimer, the term of this patent is extended or adjusted under 35 U.S.C. 154(b) by 211 days.

(21) Appl. No.: 15/293,179

(22) Filed: Oct. 13, 2016

(65) Prior Publication Data

US 2017/0106225 A1 Apr. 20, 2017

(30) Foreign Application Priority Data

Oct. 16, 2015 (EP) ..... 15382511

(51) Int. Cl.
*A63B 21/065* (2006.01)
*A63B 21/00* (2006.01)
*A63B 21/16* (2006.01)

(52) U.S. Cl.
CPC ..... *A63B 21/065* (2013.01); *A63B 21/00061* (2013.01); *A63B 21/16* (2013.01);
(Continued)

(58) Field of Classification Search
CPC ..... A63B 21/065; A63B 21/4021; A63B 21/4043; A63B 21/4015; A63B 21/16;
(Continued)

(56) References Cited

U.S. PATENT DOCUMENTS 3,114,982 A * 12/1963 McGowan ..... A43B 3/0031 36/132
3,334,898 A * 8/1967 McCrory ..... A63B 21/065 36/132

(Continued)

FOREIGN PATENT DOCUMENTS

CN 2772550 Y 4/2006
EP 2055234 A1 5/2009

(Continued)

OTHER PUBLICATIONS

Extended European Search Report for Application No. EP15382511 issued by the European Patent Office, Munich, Germany dated Mar. 30, 2016.

(Continued)

*Primary Examiner* — Andrew S Lo
(74) *Attorney, Agent, or Firm* — Peter B. Scull; HDC IP Law LLP

(57) ABSTRACT

A fitness set for the practice of fitness, sport, rehabilitation or physiotherapy exercises may include at least one weight, at least one shoe support for fastening the weight to a shoe of a user, and at least one body support for fastening the weight to the body of a user, the weight having a first releasable binding element and the shoe support and the body support having at least one second releasable binding element matching the first releasable binding element of the weight, configured so that that the weight may be releasably attached to the shoe support or to the body support. Methods for fitness training are also provided.

5 Claims, 7 Drawing Sheets

(52) U.S. Cl.
CPC ..... *A63B 21/4009* (2015.10); *A63B 21/4015* (2015.10); *A63B 21/4021* (2015.10); *A63B 21/4043* (2015.10); *A63B 2209/08* (2013.01); *A63B 2209/10* (2013.01)

(58) Field of Classification Search
CPC ..... A63B 21/00061; A63B 21/4009; A63B 2209/08; A63B 2209/10; A63B 21/4034; A63B 21/0557; A63B 2210/50; A63B 2225/09; A63B 21/4011; A63B 21/0442; A63B 21/4025; A63B 23/12; A63B 23/03508; A63B 23/04; A63B 2208/0204; A63B 21/1609; A63B 21/169; A63B 21/4013; A63B 23/03575; A63B 23/10; A63B 23/16; A63B 69/0059
See application file for complete search history.

(56) References Cited

U.S. PATENT DOCUMENTS 4,231,170 A 11/1980 Griswold
4,247,097 A * 1/1981 Schwartz ..... A63B 21/065 2/158
4,258,914 A 3/1981 Lalli
4,322,072 A * 3/1982 White ..... A63B 21/065 482/105
4,355,801 A 10/1982 Thomsen
4,458,432 A 7/1984 Stempski
4,507,882 A 4/1985 Harrell
4,536,975 A 8/1985 Harrell
4,556,215 A * 12/1985 Tarbox ..... A63B 21/065 2/161.1
4,575,075 A * 3/1986 Tarbox ..... A63B 21/065 2/161.1
4,632,389 A * 12/1986 Moss ..... A42B 1/24 128/DIG. 15
4,777,743 A * 10/1988 Roehrig, Jr. ..... A43B 3/0031 36/132
4,823,426 A 4/1989 Bragga
4,838,546 A * 6/1989 Winston ..... A63B 21/065 482/105
5,127,891 A * 7/1992 Winston ..... A63B 21/065 482/105
5,265,353 A 11/1993 Marega et al.
5,311,679 A 5/1994 Birch, Sr.
5,459,947 A 10/1995 Lasher
5,542,896 A 8/1996 Qaiesi et al.
5,632,709 A * 5/1997 Walsh ..... A43B 3/0078 36/136
5,683,335 A * 11/1997 Groves ..... A43B 19/005 482/105
5,728,032 A 3/1998 Glass
5,868,652 A * 2/1999 Spletzer ..... A63B 21/0605 2/22
5,893,223 A 4/1999 Glass
6,010,438 A * 1/2000 Fitzgerald ..... A63B 21/065 36/132
6,039,677 A * 3/2000 Spletzer ..... A63B 21/0605 2/22
6,357,147 B1 3/2002 Darley et al.
6,742,288 B2 6/2004 Choi
7,000,337 B2 * 2/2006 Harrington ..... A43B 5/00 36/132
7,063,650 B1 6/2006 Beausoleil
7,152,286 B2 12/2006 Rooney et al.
7,497,035 B2 * 3/2009 Kos ..... A43B 1/0081 36/128
7,559,127 B2 7/2009 Rooney et al.
7,833,137 B2 11/2010 Gamuette
9,009,992 B2 4/2015 Baker et al.
2003/0192198 A1 10/2003 Wright
2004/0035025 A1 2/2004 Choi
2005/0224672 A1 10/2005 Butt et al.
2005/0252042 A1 11/2005 Harrington
2007/0089322 A1 4/2007 Rooney et al.
2008/0248932 A1 * 10/2008 Geritano ..... A63B 21/065 482/105
2010/0050477 A1 * 3/2010 Zeek ..... A43B 5/00 36/132
2010/0192419 A1 * 8/2010 Jack ..... A43B 1/0054 36/132
2010/0210428 A1 * 8/2010 Garnuette ..... A63B 21/06 482/105
2011/0009713 A1 1/2011 Feinberg
2012/0028766 A1 * 2/2012 Zeek ..... A63B 21/065 482/105
2012/0028767 A1 * 2/2012 Zeek ..... A63B 21/065 482/105
2013/0008058 A1 1/2013 Jasmine
2014/0200412 A1 * 7/2014 Martinez ..... G06F 15/00 600/300
2015/0264997 A1 * 9/2015 Myles ..... A43B 7/38 36/81
2016/0029742 A1 * 2/2016 Cifo Garcia ..... A43B 19/005 36/132
2016/0345656 A1 * 12/2016 Ramirez, II ..... A43B 5/18
2016/0375334 A1 12/2016 Ragen
2018/0326246 A1 11/2018 Borés Cifo

FOREIGN PATENT DOCUMENTS

ES 269613 U 8/1983
ES 1046537 U 1/2001
ES 1079084 U 4/2013
GB 2139103 A 11/1984
WO 2014140400 A1 9/2014

OTHER PUBLICATIONS

Spanish version of the International Search Report and Written Opinion for PCT application No. PCT/ES2014/070181 issued by the Spanish Patent and Trademark Office dated Apr. 15, 2014, 8 pages, Madrid Spain.
English Translation of the International Search Report and Written Opinion for PCT application No. PCT/ES2014/070181 issued by the Spanish Patent and Trademark Office dated Apr. 15, 2014, 9 pages, Madrid Spain.

* cited by examiner

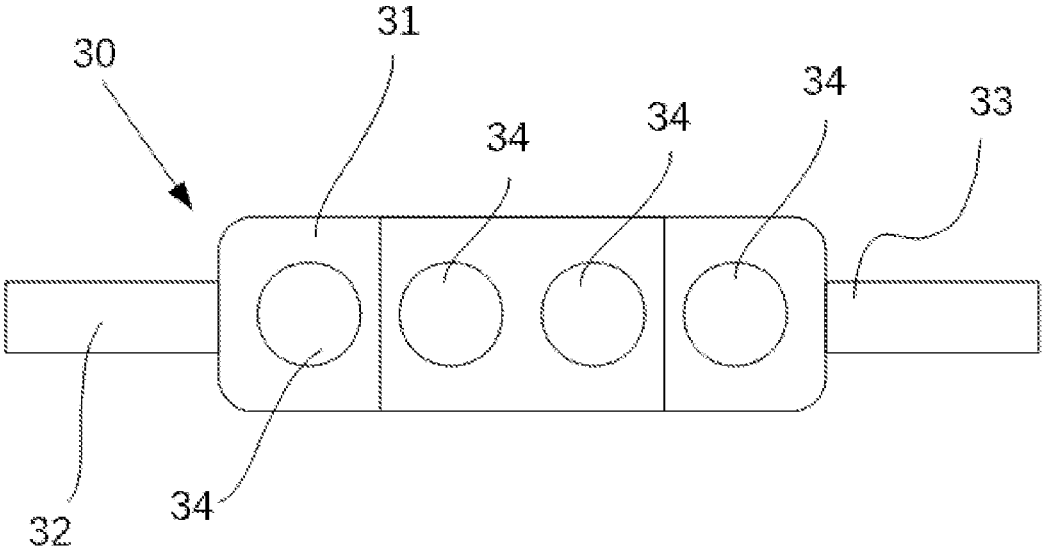
FIG. 3
FIG. 4b
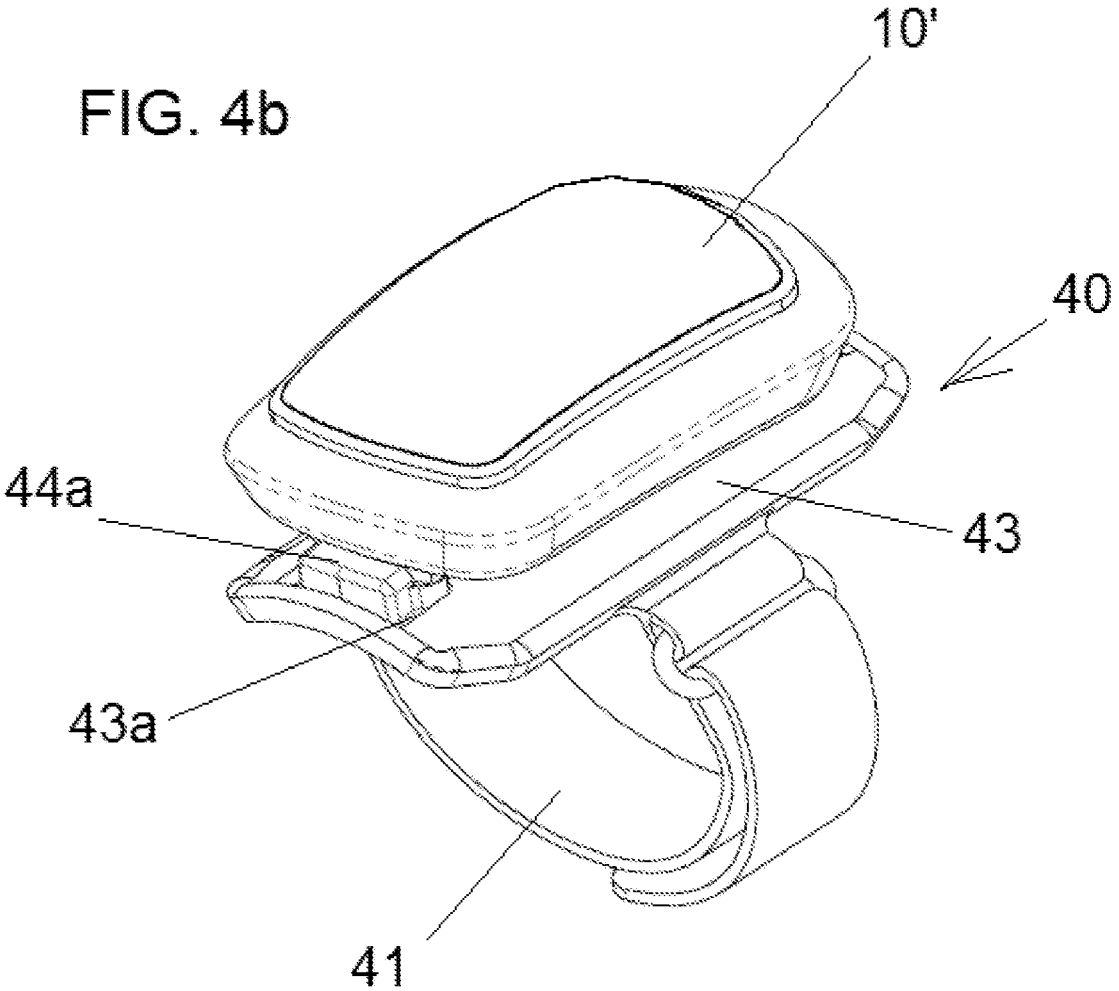

FITNESS SET

The present disclosure relates to fitness sets and/or methods for the practice of fitness exercises, indoor or outdoor sports, physical therapy exercises, or the like.

BACKGROUND

It is known for sportspersons such as runners, footballers and the like to practice fitness exercises using weights that are placed on the instep of the shoe, for example using a certain weight during a certain number of exercises, minutes, etc., changing the weights, or alternating between exercises with a weight and exercises without a weight.

In some circumstances, such as when users are exercising outdoors, they may have the problem of carrying the weights that are not being used. The user may carry a bag, a backpack or conventional waist bag to store the weight or weights when they are not arranged on the shoe instep, but with this solution the weights are not arranged in the most comfortable position for the user, and furthermore they may move or jump within the container when the user runs or performs other exercises. On the other hand, the weights can only be used for exercises on the shoe instep.

It has now been found that the versatility of the exercises, as well as the comfort of the sportsperson practicing such exercises, may be improved, and the above problems may be solved at least to some extent.

SUMMARY

The present subject matter solves at least partly one or more of the above problems, and provides a fitness set and/or method including use of at least one weight, at least one shoe support for fastening the weight to a shoe of a user, and at least one body support for fastening the weight to the body of a user, wherein the weight has a first releasable binding element and the shoe support and the body support have at least one second releasable binding element matching the first releasable binding element of the weight, configured so that the weight may be releasably attached to the shoe support or to the body support.

Additional objects, advantages and features hereof will become apparent to those skilled in the art upon examination of the description, or may be learned by practice hereof.

BRIEF DESCRIPTION OF THE DRAWINGS

Particular implementations of the present subject matter will be described in the following by way of non-limiting examples, with reference to the appended drawings, in which:

FIG. 3 is a schematic view of an implementation of a body support of a fitness set, including binding elements for releasably attaching weights thereto;

FIGS. 4*a* and 4*b* are schematic views of a body support of a fitness set, in this case a wristband, according to another implementation disclosed herein;

DETAILED DESCRIPTION

Figure 1A:
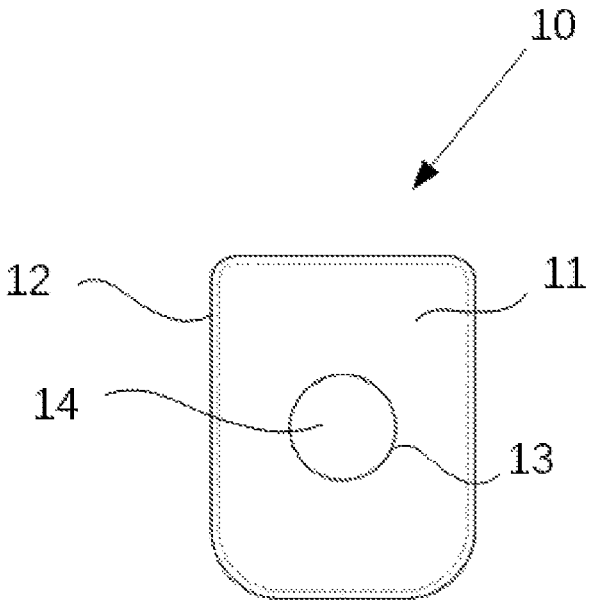
FIGS. 1*a* and 1*b* are schematic views of a weight of a fitness set according to an implementation disclosed herein.

Fitness sets and methods are shown in the drawings and described herein. Such a fitness set and/or method hereof may include use of at least one weight, at least one shoe support for fastening the weight to a shoe of a user, and at least one body support for fastening the weight to the body of a user, wherein the weight has a first releasable binding element and the shoe support and the body support have at least one second releasable binding element matching the first releasable binding element of the weight, configured so that the weight may be releasably attached to the shoe support or to the body support.

On the one hand, a set hereof may allow the user to exercise placing weights on different parts of the body, for example the wrists, arms, legs, etc. On the other hand, it may provide the user with a comfortable way for storing and carrying the weights that are not being used on the shoe, attaching them firmly to another part of the body, such as for example around the waist, where the muscular activation is practically non-existent. The weights are securely attached by the binding elements, and therefore do not run the risk of bouncing, jumping and/or moving during the exercises.

It will therefore be understood that a fitness set as disclosed may have a number of advantages over other known fitness products. For example, with a set hereof, a user may practice fitness exercises with and without weights on the feet, wrists, or other parts of the body, with different weights at different times, for example according to a pre-determined fitness plan.

Furthermore, the user may carry all the different weights with him/her at all times very comfortably, and therefore the set is particularly useful for outdoor practice, wherein the user has no possibility of leaving somewhere the weights that are not being employed. However, also in indoor practice it may be an advantage for the user to carry the weights at all times, in order to avoid any losses or confusion with other sportspersons' fitness materials.

According to some implementations, the first and second releasable binding elements may form a magnetic binding system, a hook-and-loop binding system, or a snap-fit binding system.

The body support may include in some examples wristbands and/or a belt band, and the shoe support may include a support plate to be attached on the instep of the shoe with the shoelaces, or a harness to be releasably wrapped around the shoe. The use of a support attached on the instep to which a weight may be fastened, may enable improvement of the technique of the user by increasing the self-consciousness or proprioception.

Alternatively and/or additionally, a method for fitness training is provided. Firstly a support may be fastened to a shoe of the user. Then, training series with and without weights may alternatively be realized, wherein the training series with weight may be realized during a predefined period of time which depends on the total training time.

A method hereof may alternate series with and without fastening a predetermined weight and may allow and/or improve muscular recovery. It may also delay the possible appearance of technique deterioration and may enable more opportunities of self-consciousness or proprioception.

A still further method for fitness training may also be provided. Firstly, a shoe support may be fastened on the instep of the shoes of a user. Secondly, a body support may be fastened to the body of the user and then, series with and without predetermined weights fastened to the shoe supports may alternatively be realized. To alternate the series, predetermined weights may be fastened to the body support and a first training series may be realized. Afterwards, the predetermined weights may be changed from the body support to the shoe supports, and a second training series may be realized. And finally, the predetermined weights may be changed back from the shoe supports to the body support and a third training series may be realized.

Figure 1B:
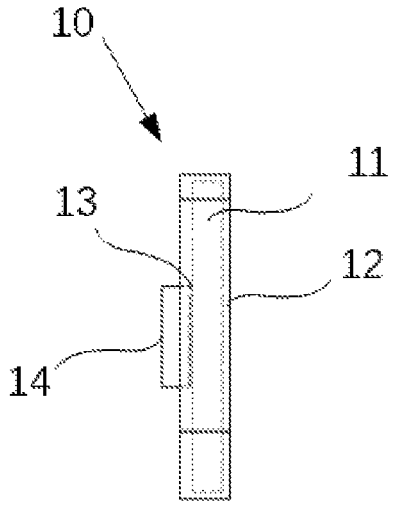

FIGS. 1*a* and 1*b* show an implementation of a weight 10 of a fitness set, which may include an inner metal core 11 (shown in dotted lines) and an outer casing 12 of polymer such as polypropylene. The outer casing 12 may include a recess 13 in which a first releasable binding element 14 may be firmly attached, for example by an adhesive.

The binding element 14 may be, in this example, a magnet, but in other implementations it may also be another kind of binding or fastening element, such as one of the components of a snap-fitting system which is engaged and disengaged by exerting a certain pressure, or of a hook-and-loop system, e.g. Velcro®.

The fitness set disclosed herein may include a number of weights, for example two identical weights for the feet, and/or weights having different weight values, for allowing the user to vary the effort during the exercises.

Figure 2A:
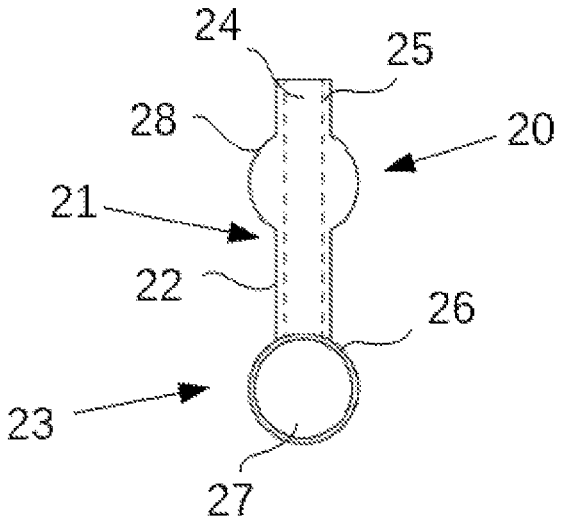
FIGS. 2*a* and 2*b* are schematic views of a shoe support of a fitness set according to an implementation disclosed herein, suitable to receive the weight of FIGS. 1*a* and 1*b;*
Figure 2B:
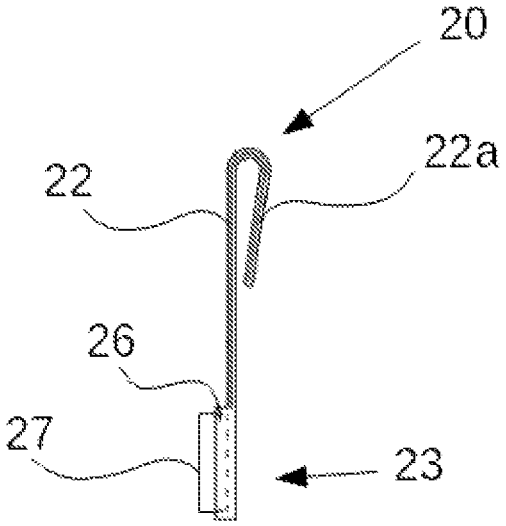

FIGS. 2*a* and 2*b* show an implementation of a shoe support 20 of the same fitness set to which the weight of FIGS. 1 and 2 may belong. As shown, the shoe support 20 may include a support plate 21, which in this case is shaped as an elongate strip 22, bent to form a tongue 22*a* at one end and having an enlarged head 23 at the other end. It may include a rigid core 24 (shown in dotted lines), for example made of plastic, and an outer casing 25, for example made of polyamide with fiberglass.

The head 23 includes a recess 26 in order to receive a second releasable binding element 27, matching the first releasable binding element 14 of the weight 10. For example, the second binding element 27 may be a magnet suitably configured and arranged in the recess 26 to be attracted by the magnet fixed to the weight 10.

In accordance with the first binding element 14, the second binding element 27 may also be a component of a snap-fitting system or of a hook-and-loop system.

The magnets or other releasable binding elements 14 and 27 may also have different shapes from that shown in FIGS. 1*a*, 1*b*, 2*a*, 2*b*, and may be attached in different positions on the weight and shoe support 20; similarly, they may be attached by injection, by an adhesive or in any other way.

The shoe support 20 of FIGS. 2*a*, 2*b* is intended to be attached to a shoe of the user, by placing the tongue 22*a* of the support plate 21 under the shoelaces such that it remains firmly attached to the shoe when the shoelaces are fastened, while the strip 22 and head 23 are arranged over the shoelaces.

The weight 10 may be fastened to the shoe using the shoe support 20, simply by engaging the magnets 14 and 27 or similar binding elements, and it may be released from the shoe when the user so desires, simply by pulling it away overcoming the magnetic force of the magnets.

The shoe support 20 shown in the Figures may have an enlargement 28 on the strip part 22, to provide a suitable surface for a logo or the like.

FIG. 3 shows an example of a body support which may be part of a fitness set. In this case the body support shown is a belt band 30, which may be used for fastening weights to the waist or hip region of a user.

The belt band 30 may include a wide strip 31, of fabric, elastomer or other flexible material, optionally with a rigid or semi-rigid core (not shown) and two terminal fastening strips 32 and 33, for example provided with complementary hook-and-loop fastening portions.

The wide strip 31 has attached thereto for one non-limiting example a minimum of two and a maximum of six releasable binding elements 34 (four in FIG. 3), such as magnets analogous to that in the shoe support 20 of FIGS. 2*a*, 2*b*, in order to allow attachment of two weights 10. The belt band 30 therefore allows releasably fastening for a non-limiting example a minimum of two and a maximum of six weights 10 to the body of the user, and more particularly to the waist, hip or the like.

A belt band such as shown in FIG. 3 may include any other number of binding elements 34, such that several weights can be attached to the belt at the same time.

Figure 4A:
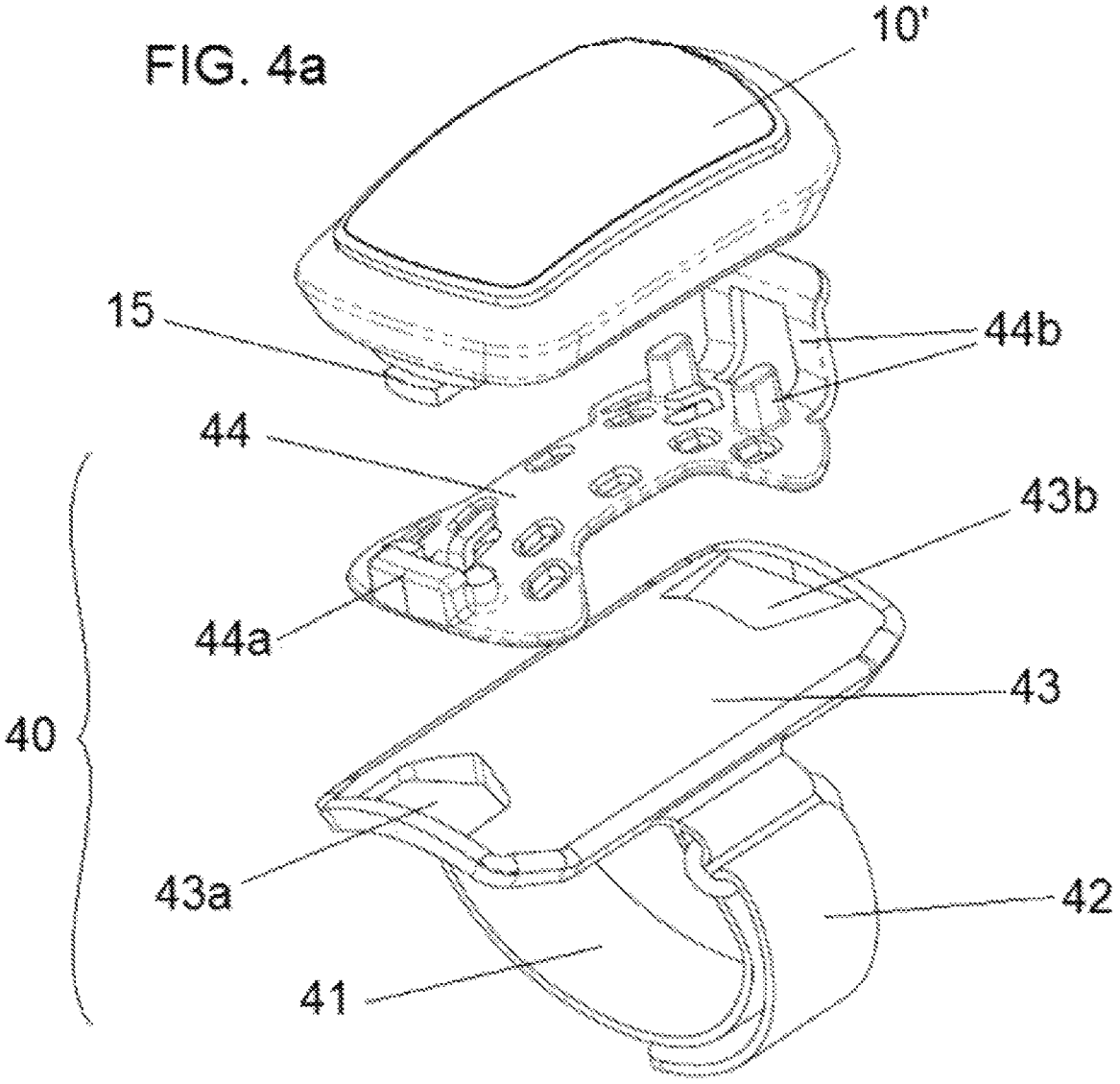

FIG. 4*a* shows in exploded view another body support according to an implementation of a fitness set, in this case a wristband 40, with a weight 10'.

The wristband 40 may include a strap 41, which may have a hook-and-loop closure 42 to allow attaching it firmly to the wrist of a user, and a plate 43 with two openings 43*a*, 43*b* attached to the strap 41.

A fitting 44, including releasable snap-fit binding elements 44*a*, 44*b*, is provided to be arranged between the user's wrist and the plate 43, with the binding elements 44*a*, 44*b* protruding through the openings 43*a*, 43*b*, respectively, such that a weight 10' having complementary binding elements may be releasably snap-fitted to the wristband 40.

In FIG. 4*b* the wristband 40 is fitted with the weight 10' through the plate 43 and the fitting 44; the position of the fitting 44 underneath the plate 43 can be seen in this Figure.

Only one snap-fitting binding element 15 of weight 10' is visible in FIGS. 4*a* and 4*b*. Another element, which is complementary to binding element 44*b*, is provided at the other end of the weight from element 15.

The fitting 44, and weights with complementary snap-fit binding elements, such as weight 10' shown in FIGS. 4*a* and 4*b*, may also be used on other body supports different from the wristband.

The fitting 44 itself may also be a support plate, and may be used as a shoe support to be attached under the shoelaces as disclosed in document WO2014/140400.

Other body supports may be envisaged, for example for releasably fastening weights such as that in FIGS. 1*a*, 1*b*, that in FIGS. 4*a*, 4*b*, or others, to other parts of the body such as legs, arms, shoulders, neck, etc.

Like in the case of the shoe support described above, a body support may be provided with a different kind of binding element, such as a component of a snap-fitting fitting system or of a hook-and-loop system, or others, matching the binding element provided on the weight.

A user may for example wear a belt band, wristbands and shoe supports; he/she may attach a weight with a certain value to each shoe support, and two or four further weights, for example with different values, to the belt band, and practice a number of exercises, such as running, during a certain time.

The user may then change the weights on the shoe supports with heavier weights, and practice another batch of exercises, and later for example attach weights to the wristbands to do a batch of exercises related to the arms. All the weights that are not being used at a given time may remain attached to the belt band, without hindering the user's exercises.

Figure 5:
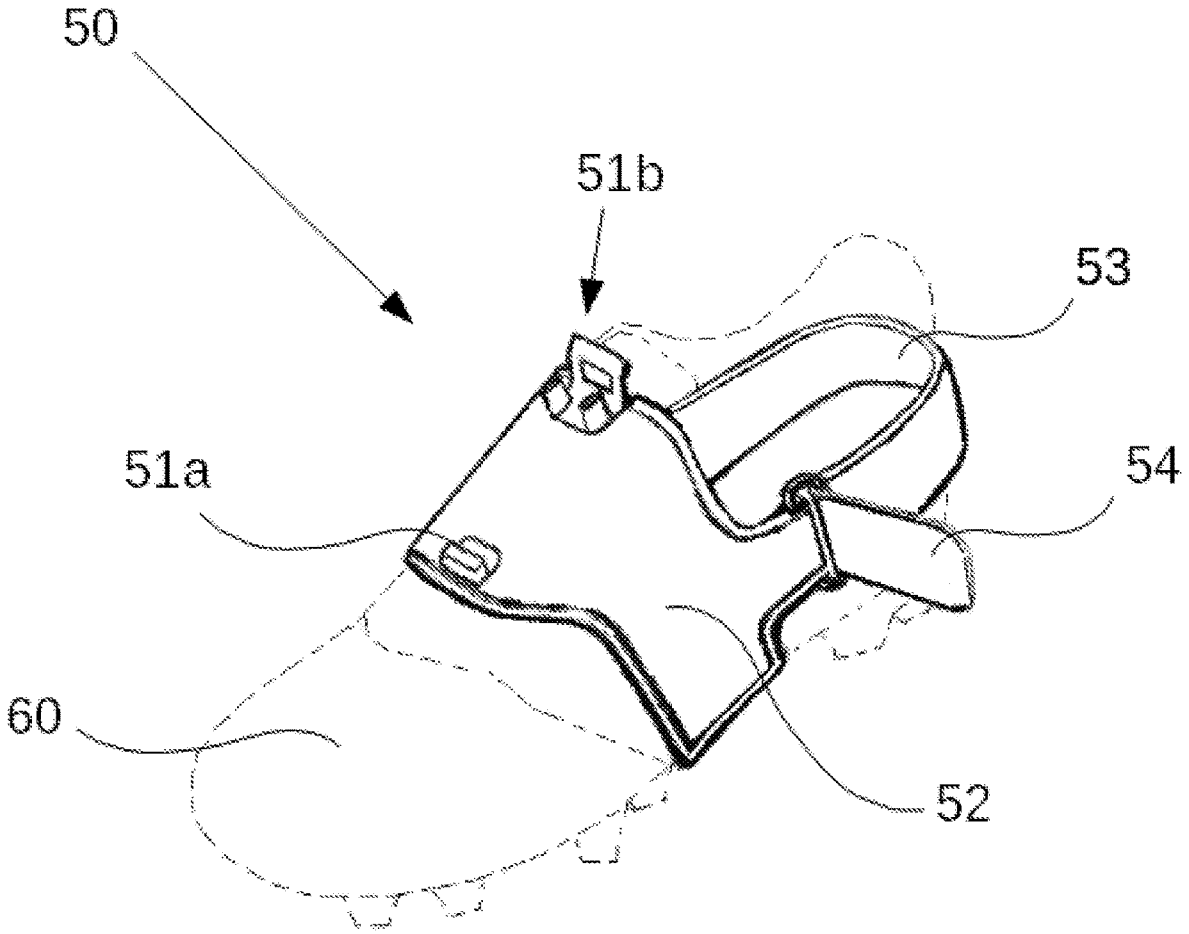
FIG. 5 is a schematic perspective view of another shoe support, according to an implementation of a fitness set.

FIG. 5 is a schematic perspective view of another shoe support, according to an implementation of a fitness set. In FIG. 5 the shoe support 50 is configured as a harness 50 with releasable binding elements 51*a*, 51*b* which may be wrapped around a shoe 60, as shown, in such a way that the binding elements 51*a*, 51*b* are positioned on the shoe instep.

In the Figure, the binding elements 51*a*, 51*b* are of snap-fit type, and are intended to allow the releasable attachment, by pressure, of a weight such as weight 10' shown in FIGS. 4*a*, 4*b*, having matching snap-fit binding elements 15. The harness 50 could also have a different kind of binding element, as explained in relation with FIGS. 2*a*, 2*b*.

The harness 50 may include, as in the Figure, a first strap 52 intended to be wrapped around the instep and pass beneath the sole of the shoe, and a second strap 53 intended to pass around the heel of the shoe. This second strap 53 may have a closure 54, such as a hook-and-loop closure, so that the harness is easier to fit to the shoe and remove from the shoe. The harness may be made of a flexible and elastic material; in some implementations, the closure 54 may not be necessary if the straps are flexible.

The harness 50 may of course have other any shape compatible with the function of providing a binding element for the weight on the instep of the shoe.

The use of a shoe support configured as a harness 50 such as shown in FIG. 5, instead of one such as shown in FIGS. 2*a* and 2*b*, which is intended to be attached to the shoelaces, is particularly useful for sportspeople that practice ball sports, such as football, wherein the shoe interacts with the ball.

Removing only the weights and leaving the shoe support attached to the shoe is generally not a good solution for ball players, because the snap-fit element, magnet or other binding element may hinder the contact with the ball and also cause an injury to the player's foot in case of a strong blow between the ball and the shoe instep.

With the harness solution, a player that exercises with weights on the instep, for example before a match or while warming up can then remove the whole harness together with the weights very quickly, before playing, without the need to undo the shoelaces and lacing them again, etc.

The player can therefore benefit from the advantages of exercising with different exchangeable weights, and then remove the whole set very quickly.

In fact, a shoe support for fastening the weight to a shoe of a user, comprising a harness that is configured to be releasably wrapped around the shoe such that it allows positioning a weight on the shoe instep, may be a part of a fitness set as described herein, but may also be an independent product. In the latter case, the harness may comprise a releasable binding element, matching the binding element provided on at least one weight, or may have a weight permanently attached thereto, for example adhered or arranged in a sheath of the harness or in a pocket with an opening.

Figure 6:
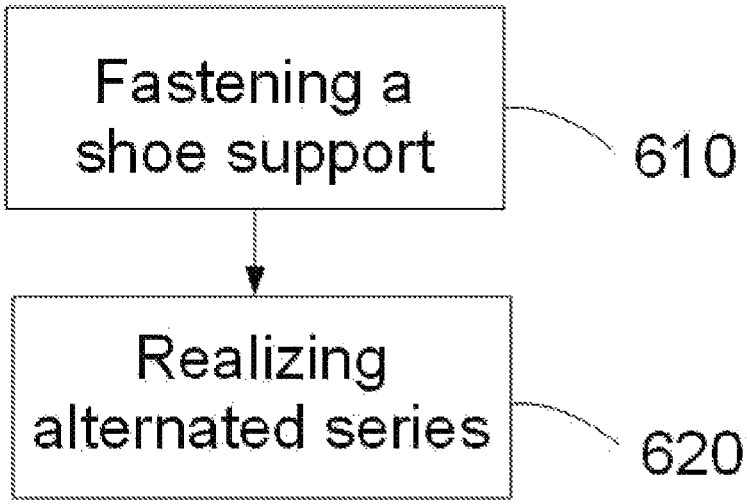
FIG. 6 shows an example of a method for fitness training.

FIG. 6 shows an example of a fitness training method to be used in a training session which may be divided into a plurality of series. Firstly, a shoe support as disclosed above may be fastened 610 to a shoe of the user. Then, the user may realize 620 series alternated with and without weight e.g. by fastening and unfastening a predetermined weight to/from the shoe support. A series with weight may be realized during a predetermined period of time which may e.g. depend on the total training time e.g. about 15-40% of the total training time.

Figure 7A:
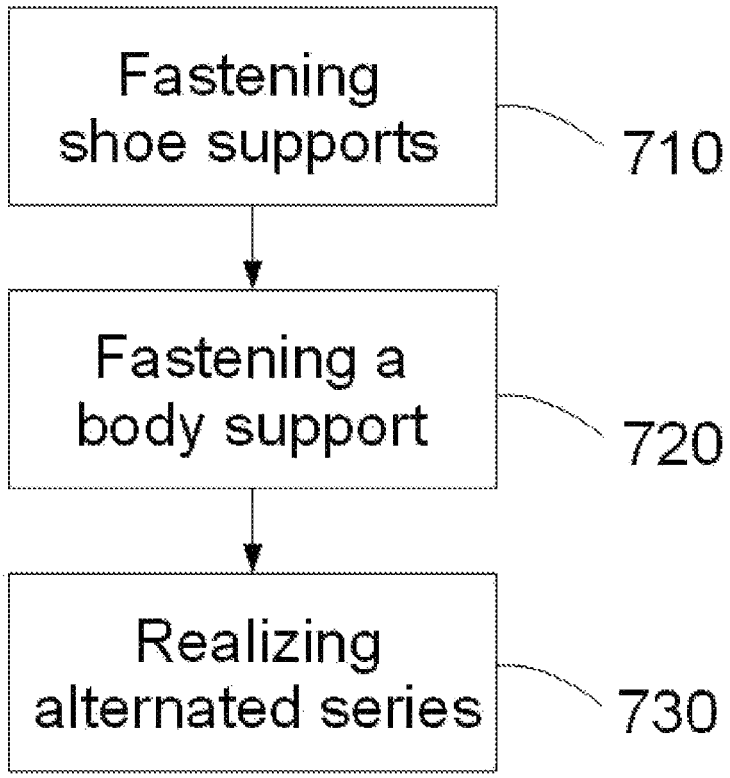
FIGS. 7*a* and 7*b* show further examples of methods for fitness training.

FIG. 7*a* shows another example of a fitness training method to be used in a training session which may be divided into a plurality of series. Before starting the training session, the user may fasten 710 a shoe support as any of those hereinbefore described to each of his/her shoes. The user may also fasten 720 a body support e.g. a belt band around his/her waist, in which several weights may be attached to avoid causing an overloading e.g. in user feet. The user may then realize 730 series alternated with and without weights fastened to the shoe supports.

Figure 7B:
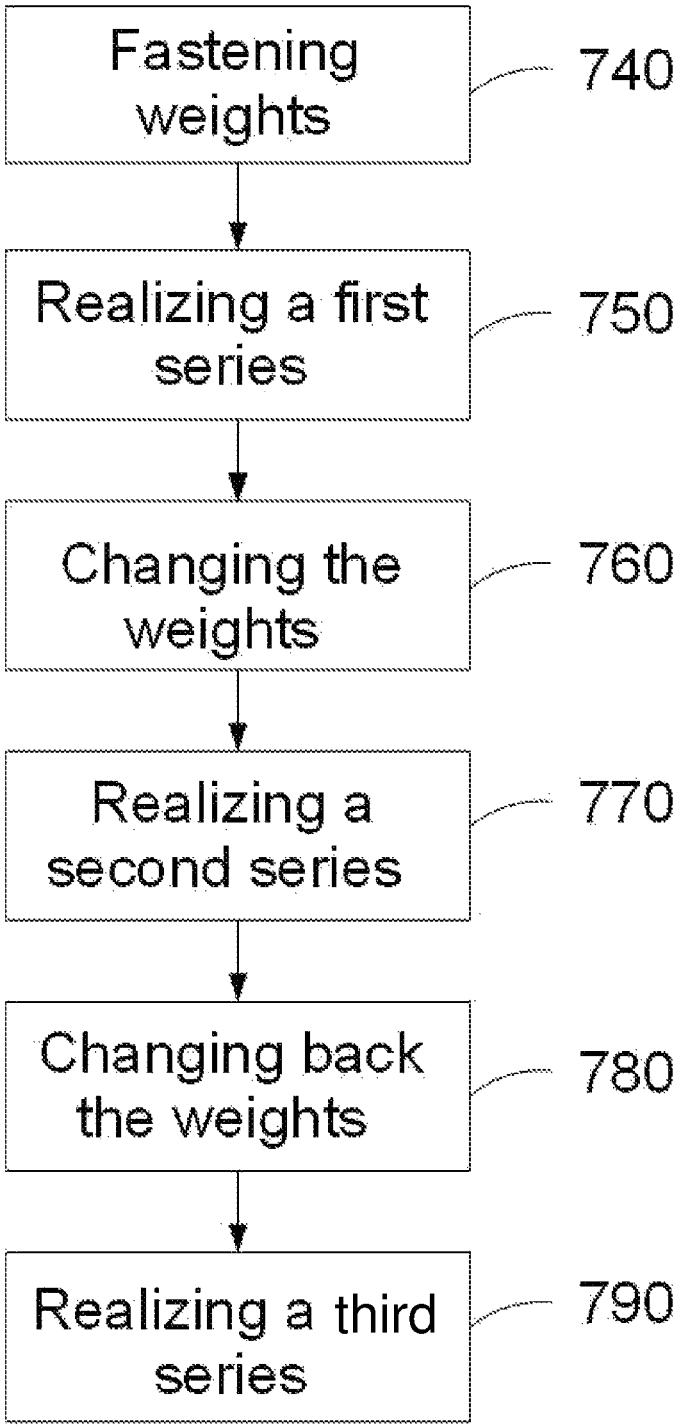

FIG. 7*b* shows a non-limiting example of how to alternate different training series. The user may firstly fasten 740 different weights e.g. of different loads, to the body support, e.g. a belt band, placed around his/her waist, i.e. a neutral zone to avoid overloading. The user may realize 750 a first series without fastening any weights to the shoe supports. Then, the user may change 760 the predetermined weights from the body support to the shoe supports, i.e. unfastening from the body support and fastening them to the shoe supports, and he/she may realize 770 a second training series. Finally, the user may change back 780 the predetermined weights i.e. unfastening them, from the shoe supports to the body support where they may be attached and he/she may realize 790 a third training series.

According to an example the last training series may be realized without having a predetermined weight fastened.

In a further example, the weight unfastened from the shoe support may be attached to a wrist support at least during a training series before being fastened to the body support.

There may be different predetermined weights e.g. with different loads or dosages, so as to selected a weight according to e.g. user characteristics such as body weight, level of performance, physical condition, etc., and/or the kind of sport routines to be realized e.g. long distance running, short distance running, sprint running, power enhancing exercises, technique exercises, functional exercises, etc.

In an example, the predefined training time in which a predetermined weight is fastened to the support may be gradually increased, e.g. in a 5% increment, after a settled period of time e.g. weekly, monthly, etc., until a fixed maximum training period of about e.g. a 40% amount of the training session.

In an example, a user may realize training sessions during a week in which a predetermined weight is fastened during training session that lasts about 15% of the training time. The following week, the user may realize the series with weight during about 20% of the training session and he/she would continue increasing the duration training sessions with weight until the series with the predetermined weight is about 40% of the entire training session.

In a further example, a plurality of the different series i.e. with and without weight, realized during the training session may be alternated.

In another example different weights i.e. of different loads, may be alternated e.g. in a training session.

In a particular example, for example a continuous run of e.g. 8 km, a user may fasten a weight at about the 25% point of the total training time. The training may include five series which may be arranged as shown in the following table 1:

TABLE 1

| | |
|---|---|
| 2 km | Without weight |
| 1 km | With weight |

TABLE 1-continued

| | |
|---|---|
| 2 km | Without weight |
| 1 km | With weight |
| 2 km | Without weight |

In a further particular example, the training session might include series of 800 m and a predetermined weight may be used during 40% of the training time. The training may include e.g. eight series, wherein three series out of eight would be realized with a weight fastened and wherein the two last series may be realized without having a predetermined weight fastened. Additionally, a recovery time of about e.g. one minute, may be carried out after each series. The training session may therefore be as follows, table 2:

TABLE 2

| | |
|---|---|
| A series of 800 m | Without weight |
| A series of 800 m | With weight |
| A series of 800 m | Without weight |
| A series of 800 m | With weight |
| A series of 800 m | Without weight |
| A series of 800 m | With weight |
| A series of 800 m | Without weight |
| A series of 800 m | Without weight |

As a consequence of being able to fasten and unfasten a predetermined weight from a fitness set as hereinbefore described, a limited, divided and alternated training session is obtained in which e.g. the feet or the wrist are not overloaded.

Although only a number of particular implementations and examples of the invention have been disclosed herein, it will be understood by those skilled in the art that other alternative implementations and/or uses of the invention and obvious modifications and equivalents thereof are possible. Furthermore, the present invention covers all possible combinations of the particular implementations described. Reference signs related to drawings and placed in parentheses in a claim, are solely for attempting to increase the intelligibility of the claim, and shall not be construed as limiting the scope of the claim. Thus, the scope of the present invention should not be limited by particular implementations, but should be determined only by a fair reading of the claims that follow.

The invention claimed is:

1. A fitness set comprising:

at least two weights, each weight having two first releasable snap-fit binding components, one at each end of the weight, two shoe supports each for fastening one of the at least two weights to respective discrete shoes of a user, each shoe support comprising a support plate configured to be attached on an instep of the respective discrete shoe with shoelaces, the support plate comprising two second releasable snap-fit binding components matching the two first releasable snap-fit binding components of each weight; and at least one body support for fastening one or more of the at least two weights to a wrist, waist, hip, leg, arm, shoulder or neck of the user's body, the body support having at least one fitting with two second releasable snap-fit binding components, one at each end of the fitting and, matching the two first releasable snap-fit binding components of the weights, the body support and the shoe support configured for each weight to be releasably attached at any one time to any one of the body support or one or the other of the two shoe supports.

2. A fitness set as claimed in claim 1, comprising a belt band as a body support, the belt band comprising at least two second releasable snap-fit binding components.

3. A fitness set as claimed in claim 1, comprising a plurality of weights having different weight values.

4. A method for fitness training comprising:

fastening shoe supports according to claim 1 on the instep of the shoes of a user;

fastening a body support according to claim 1 to the body of the user;

realizing training series alternated with and without predetermined weights fastened to the shoe supports, by fastening predetermined weights to the body support and realizing a first training series;

changing predetermined weights from the body support to the shoe supports, and realizing a second training series; and changing back the predetermined weights from the shoe supports to the body support and realizing a third training series.

5. A method as claimed in claim 4, comprising:

repeating alternating the training series with and without predetermined weights fastened to the shoe supports, wherein different predetermined weights are fastened to the shoe supports in each training series with weights fastened to the shoe supports, and the last training series is realized without weights fastened to the shoe supports.

* * * * *